US007314223B2

(12) United States Patent
Lin

(10) Patent No.: US 7,314,223 B2
(45) Date of Patent: Jan. 1, 2008

(54) BRAKE DEVICE AND WHEEL ASSEMBLY FOR SKATEBOARDS

(75) Inventor: Chorng-Jiang Lin, Taichung (TW)

(73) Assignee: Great Lotus Corporation, Taichung (TW)

( * ) Notice: Subject to any disclaimer, the term of this patent is extended or adjusted under 35 U.S.C. 154(b) by 337 days.

(21) Appl. No.: 11/095,549

(22) Filed: Apr. 1, 2005

(65) Prior Publication Data

US 2006/0220336 A1 Oct. 5, 2006

(51) Int. Cl.
*A63C 17/14* (2006.01)

(52) U.S. Cl. ..... 280/87.042; 280/11.214

(58) Field of Classification Search ..... 280/87.042, 280/87.041, 11.214
See application file for complete search history.

(56) References Cited

U.S. PATENT DOCUMENTS 3,288,251 A * 11/1966 Sakwa ..... 188/29
3,385,608 A * 5/1968 Waddell ..... 280/11.204
3,945,655 A * 3/1976 Banks et al. ..... 280/11.215
4,027,890 A * 6/1977 Volkmann ..... 280/11.207
4,033,596 A * 7/1977 Andorsen et al. ..... 280/842
4,037,852 A * 7/1977 Bayer et al. ..... 280/87.042
4,043,566 A * 8/1977 Johnson ..... 280/87.042
4,054,296 A * 10/1977 Sullins ..... 280/11.211
4,055,234 A * 10/1977 Burton ..... 188/2 R
4,084,831 A * 4/1978 Akonteh et al. ..... 280/11.215
4,099,734 A * 7/1978 Lowery ..... 280/11.216
4,943,072 A * 7/1990 Henig ..... 280/11.215
D346,418 S * 4/1994 Fischbach ..... D21/765
6,007,074 A * 12/1999 Tarng ..... 280/11.115
6,035,976 A * 3/2000 Duhamel ..... 188/5
6,296,082 B1 * 10/2001 Tsai ..... 188/19
6,659,480 B1 * 12/2003 Newman ..... 280/87.042
6,811,165 B2 * 11/2004 Chang ..... 280/87.041
6,820,881 B1 * 11/2004 Berry ..... 280/87.042
7,159,879 B2 * 1/2007 Cole ..... 280/87.042
7,172,205 B1 * 2/2007 Vujtech ..... 280/87.021
2003/0075890 A1 * 4/2003 Jacobs ..... 280/87.042
2004/0104551 A1 * 6/2004 Jacobs ..... 280/87.042
2006/0108753 A1 * 5/2006 Harnden ..... 280/11.27

* cited by examiner

*Primary Examiner*—Jeff Restifo
(74) *Attorney, Agent, or Firm*—Banger Shia

(57) ABSTRACT

A skateboard includes a deck and a plurality of trucks connected to an underside of the deck. Each truck includes two shafts and two wheels are rotatably connected to the two shafts. At least one active device is connected to a top of the deck and controlled by user's foot. The at least one active device drives a driving member which is connected to a brake cable of at least one brake device so that the user can brake the wheels by the control from his or her feet.

16 Claims, 11 Drawing Sheets

BRAKE DEVICE AND WHEEL ASSEMBLY FOR SKATEBOARDS

FIELD OF THE INVENTION

The present invention relates to a skateboard that includes two brake devices operated by feet and the wheel assembly of each wheel is easily to be assembled.

BACKGROUND OF THE INVENTION

A conventional skateboard generally includes a deck with two sets of trucks and each truck includes two wheels. The player stands on the top of the deck and controls the wheels to move forward. For safety reason, when the skateboard moves along a down slope, the player controls the skateboard to perform a zigzag movement to slow the speed so as to efficiently control the skateboard. A brake device is used to brake the skateboard when needed. The conventional brake device is controlled by hand and a brake cable is connected between the brake lever and the brake mechanism located beside the wheels. However, the player cannot perform some typical movements if one hand has to grasp the brake device. Besides, the long brake cable might tangle objects during playing the skateboard and this could lead to a unexpected result. Also, the long brake cable is not convenient for carry of the skateboard.

The conventional wheels of the skateboard are made to be a one-piece member and includes a rim and a tire which is mounted to the rim. Once the rim or the tire is damaged, the whole wheel has to be replaced. Some rims of wheels are composed of two side parts which are connected with each other by a plurality of bolts. When dis-assembling the wheel, all the bolts have to be removed and this is a time-consuming job. The two parts have different shapes which restrict the way that assemblers assemble them. Besides, the two parts needs two different molds to manufacture.

The present invention intends to provide a skateboard that includes two brake devices each include a strap on a top of the deck and the straps are controlled by player's feet. There is no long brake cable extending from the wheels. The wheel assembly of the skateboard is easily assembled and may be cooperated with different types of tires.

SUMMARY OF THE INVENTION

The present invention relates to a skateboard which comprises two trucks connected to an underside of a deck and two shafts are connected to two ends of each of the two trucks so that two wheels are rotatably connected to the shafts. At least one active device is connected to a top of the deck and connected to a driving member located at the underside of the deck. The at least one active device is controlled by user's foot. The driving member is connected to a brake cable of at least one brake device for stopping the wheels.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
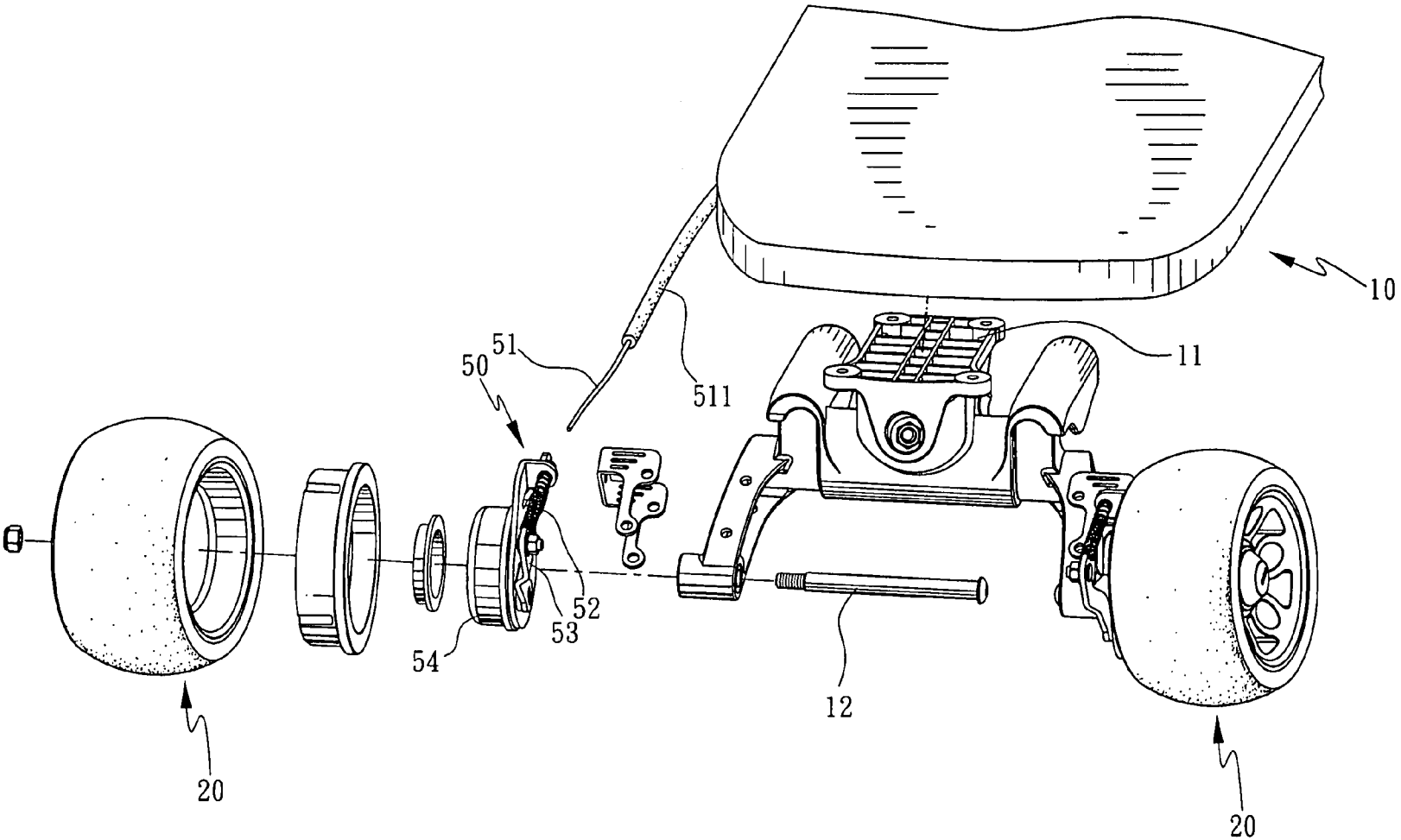
FIG. 1 is an exploded view to show the wheel and the brake device of the skateboard of the present invention.
Figure 2:
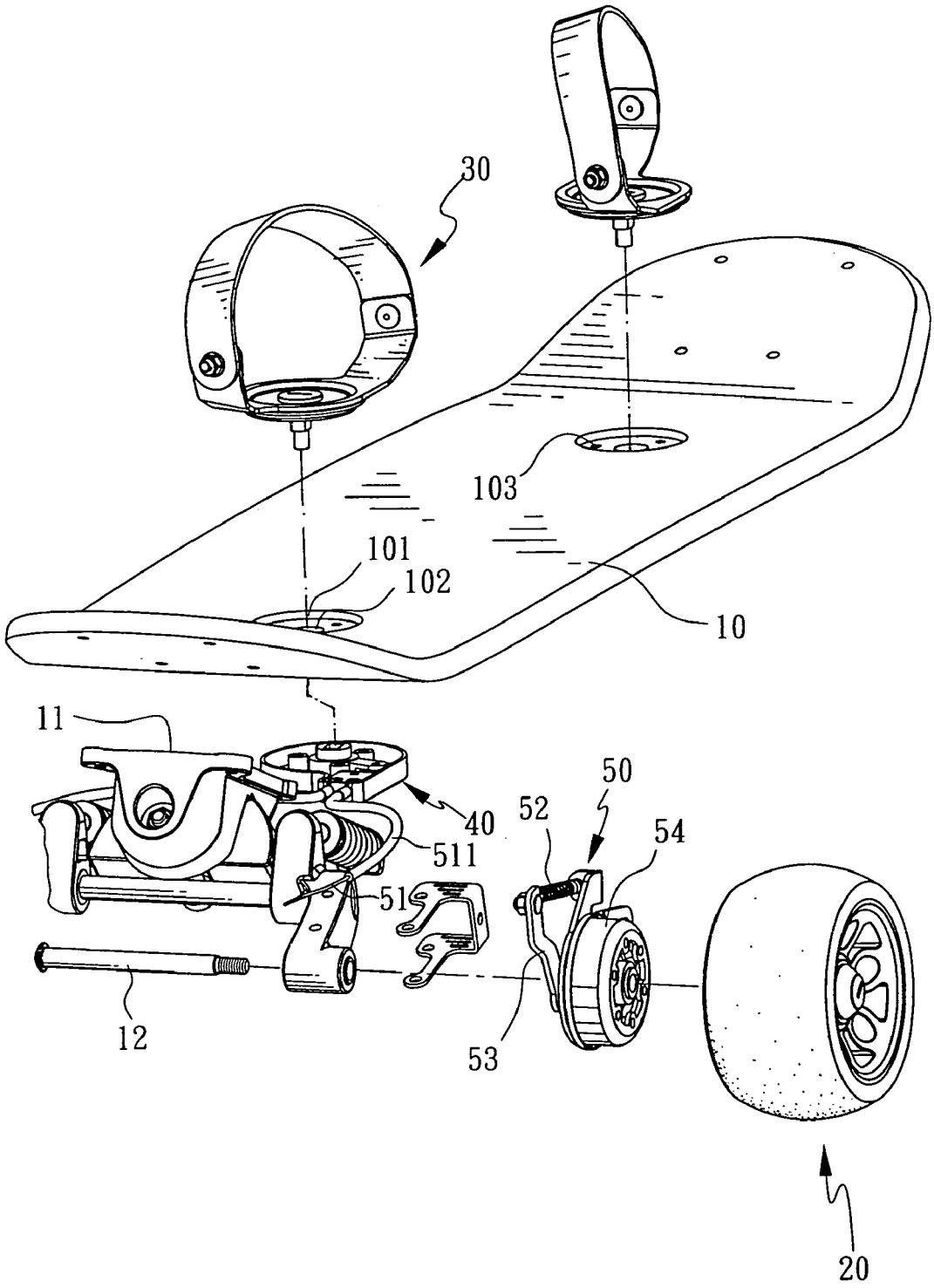
FIG. 2 is an exploded view to show the wheel, the brake device and the active device of the skateboard of the present invention.

Referring to FIGS. 1 to 2, the skateboard of the present invention comprises a deck 10 and two trucks 11 are connected to an underside of the deck 10. Two shafts 12 are connected to two ends of each of the two trucks 11 and two wheels 20 are rotatably connected to each of the shafts 12.

At least one active device 30 is connected to a top of the deck 10 and controlled by user's foot.

At least one synchronic device 40 is connected to the underside of the deck 10 and controlled by the at leas tone active device 30 so as to synchronically pull a plurality of brake cables 51 of at least one brake device 50.

At least one brake device 50 is cooperated with the wheels 20 and able to stop the wheels 20. The brake device 50 is known to the person with knowledge of this field and will not be described in detail.

The deck 10 includes a receiving port 101 for receiving the at least one active device 30 and the receiving port 101 includes a through hole 102 such that the at least one active device 30 is pivotably connected to the deck 10 via the through hole 102. A plurality of fixing portions 103 are defined in the underside of the deck 10 and located around the through hole 102 so that the at least one synchronic device 40 is connected to the deck 10.

Figure 3:
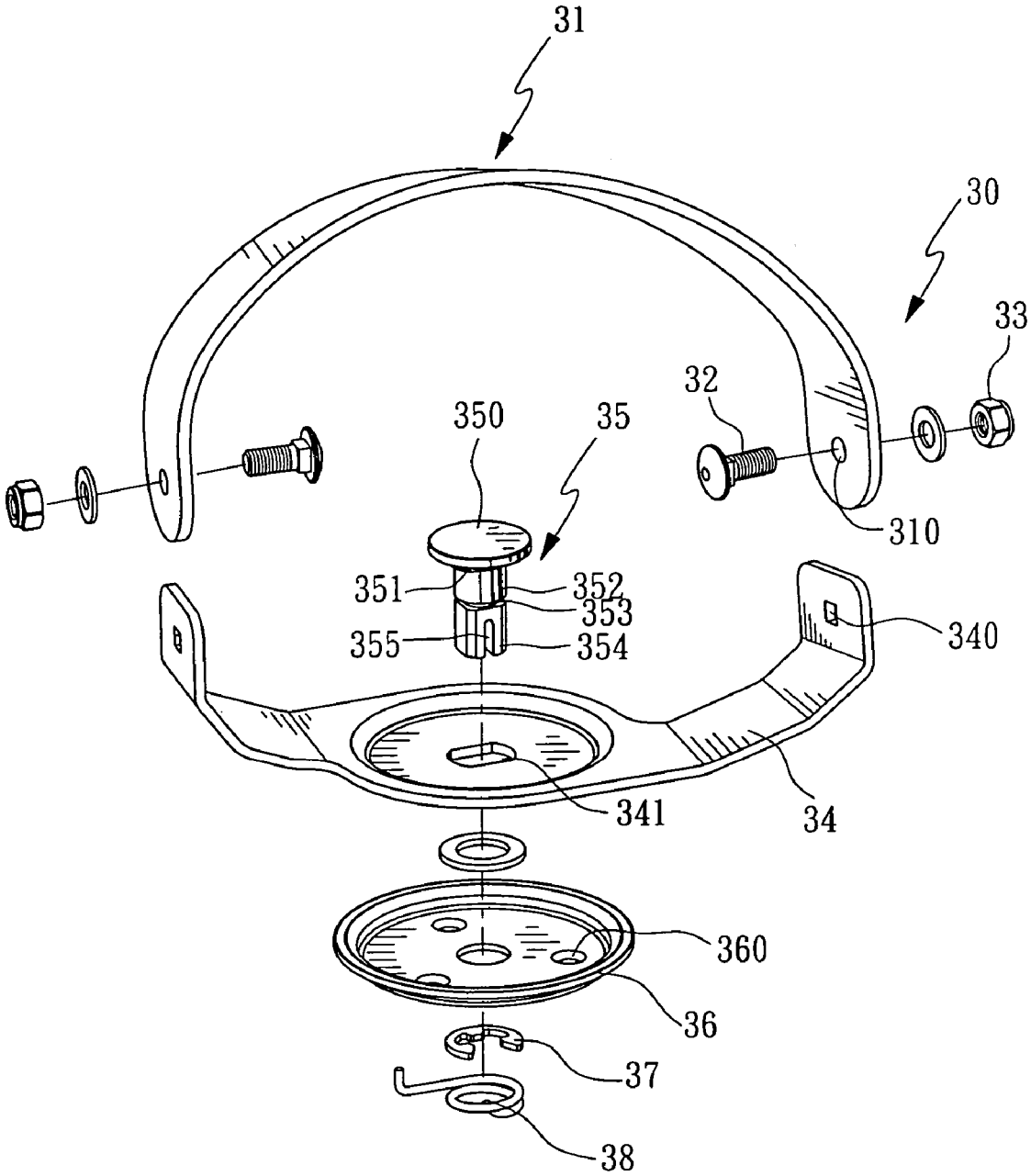
FIG. 3 is an exploded view to show active device of the skateboard of the present invention.

As shown in FIG. 3, the at least one active device 30 has a driving member 34 which is connected to the brake cables 51 of the at least one brake device 50 via the at least one synchronic device 40. The at least one active device 30 includes a strap 31 which is located at the top of the deck 10 so that the user's foot is strapped by the strap 31. The driving member 34 is connected to the strap 31. Two connection ends 310 are defined at two ends of the strap 31 and two positioning members 32 extend through the two connection ends 310 and two holes 340 of the driving member 34, and are threadedly connected with two nuts 33. The driving member 34 includes a polygonal hole 341 through which a driving piece 35 extends. The driving piece 35 includes a top flange 350, a polygonal section 351 extending from the top flange 350, a cylindrical section 352 connected to the polygonal section 351 and an engaging end 354 connected to the cylindrical section 352. The polygonal section 351 is engaged with the polygonal hole 341 in the driving member 34 so as to drive the driving member 34. The cylindrical section 352 extends through a disk 36 and includes a groove 353 with which a clamp 37 is engaged.

The engaging end 354 is connected to the at least one synchronic device 40. The engaging end 354 includes a notch 355 and an end of a torsion spring 38 is engaged with the notch 355. The other end of the torsion spring 38 is fixed to the disk 36 which includes connection holes 360 for being connected to the deck 10. By the torsion spring 38, the strap and the driving member 34 are able to return to their initial position after completion of the braking action.

Figure 4:
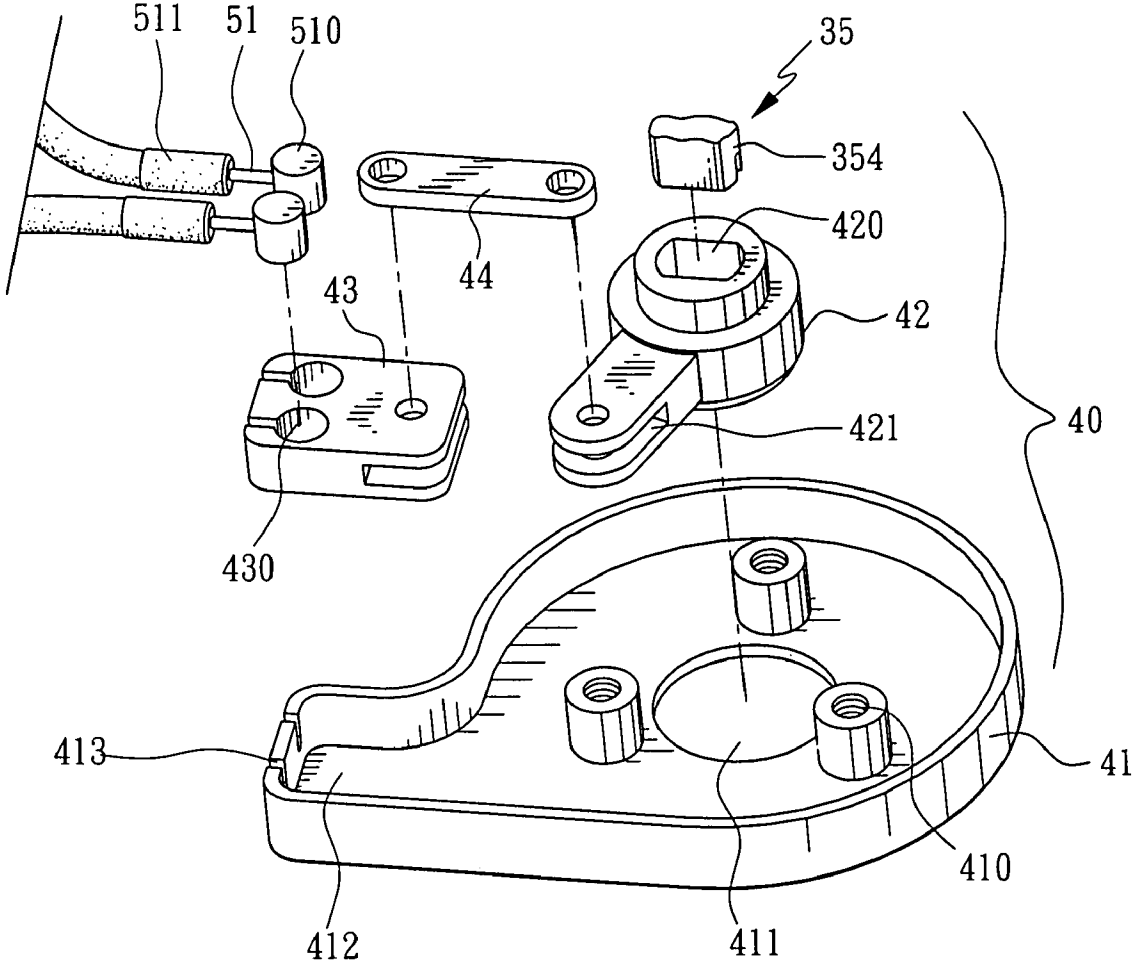
FIG. 4 is an exploded view to show the synchronic device of the skateboard of the present invention.
Figure 5:
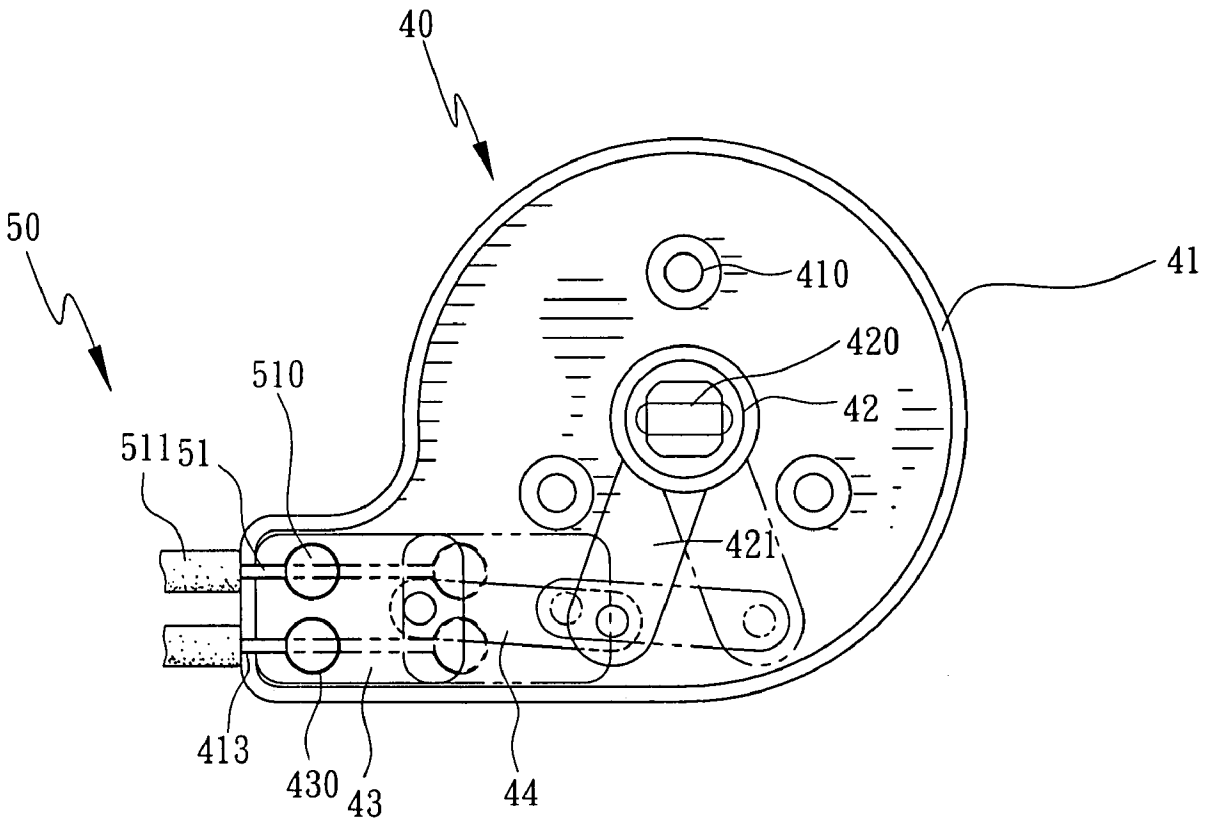
FIG. 5 is an exploded view to show the synchronic device of the skateboard of the present invention.

As shown in FIGS. 4 and 5, the at least one synchronic device 40 includes a case 41 which includes connection tubes 410 so as to be fixed to the deck 10. A central hole 42 is defined in a center of the case 41 and an arm 42 is pivotably engaged with the central hole 42. The case 41 includes a guide portion 412 and a connection board 43 is received in the guide portion 412. A link 44 is pivotably connected between the connection board 43 and the arm 42. Two apertures 413 are defined through a wall of the guide portion 412 so that the brake cables 51 extend through the apertures 413.

The arm 42 includes a polygonal hole 420 and the engaging end 354 of the driving piece 35 is engaged with the polygonal hole 420. A slot 421 is defined in an end of the arm 42 and one end of the link 44 is pivotably engaged with the slot 421. The other end of the link 44 is pivotably connected to the connection board 43. Two receiving recesses 430 are defined in the connection board 43 so as to receive terminals 510 of the brake cables 51 therein. The sheaths 511 of the brake cables 51 are stopped by the outside of the guide portion 412 of the case 41.

The brake device 50 is a drum brake device and connected to the brake cables 51. The brake cables 51 drives the drum brake device 50 by a spring 52 and a crank 53.

Figure 6:
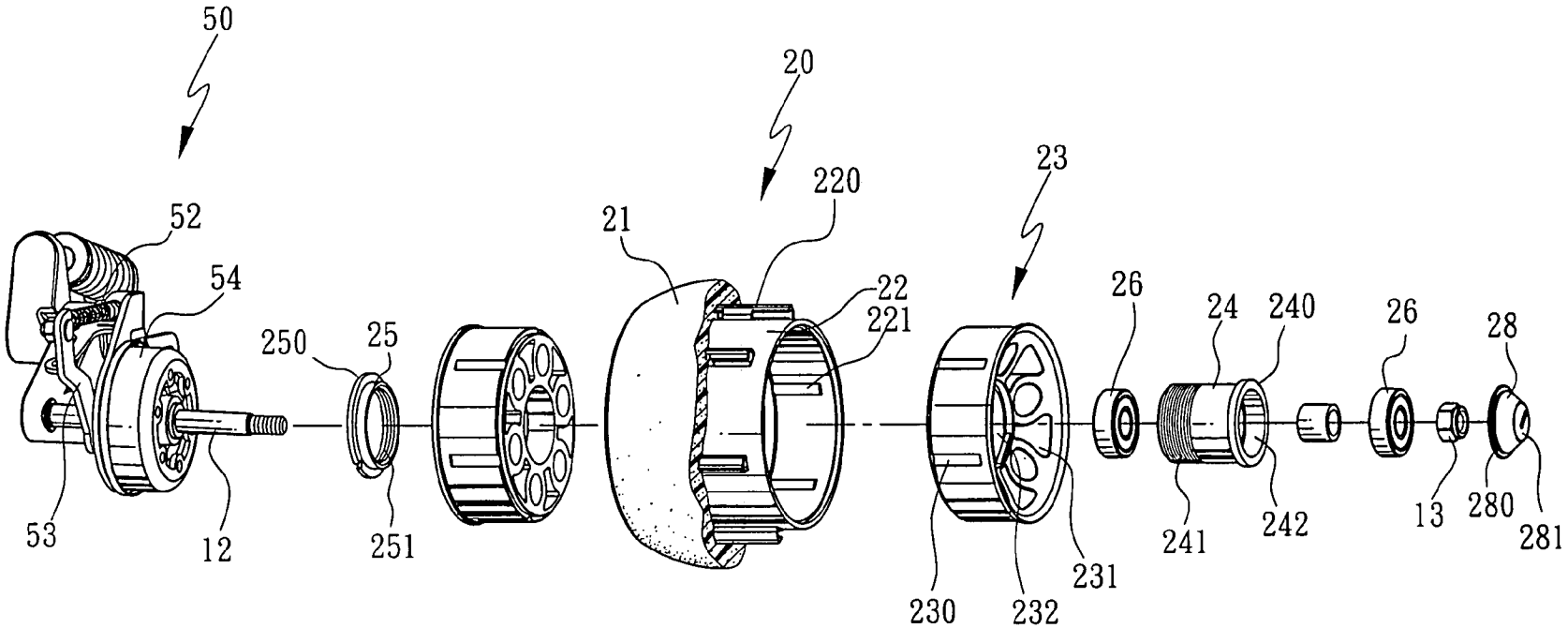
FIG. 6 is an exploded view to show the wheel assembly of the skateboard of the present invention.
Figure 7:
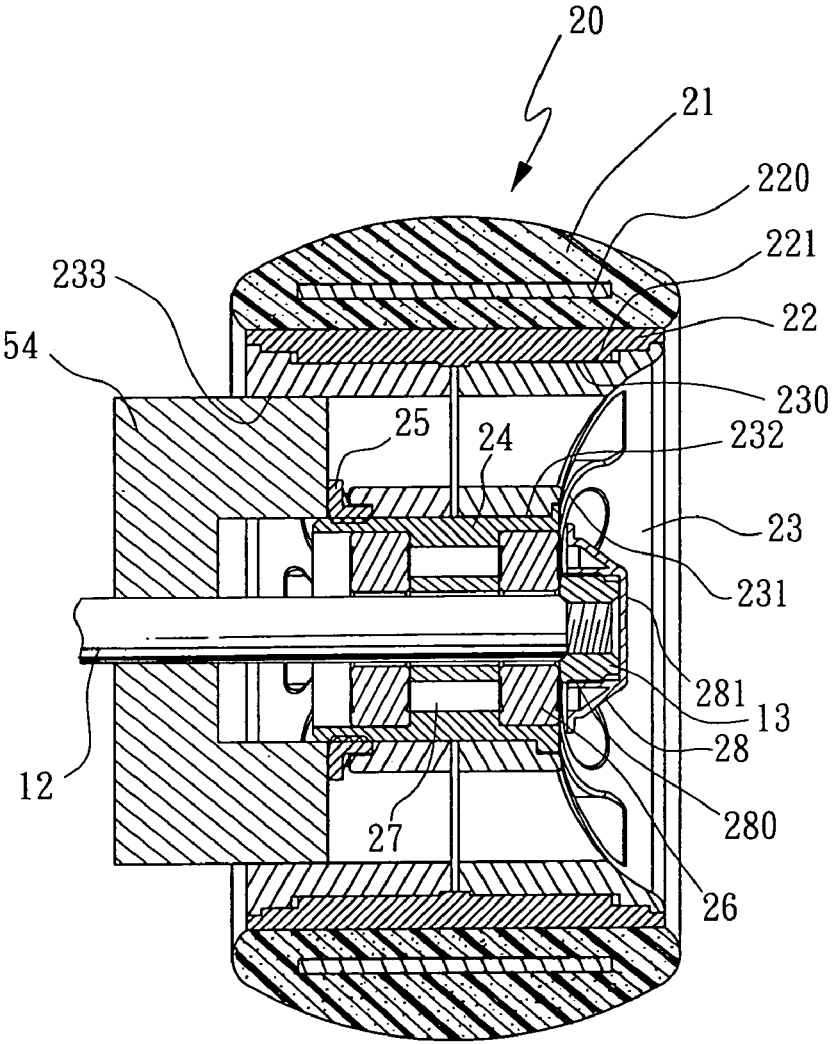
FIG. 7 is a cross sectional view to show the wheel assembly of the skateboard of the present invention.

As shown in FIGS. 6 and 7, the wheel 20 includes a rim 22 and a tire 21 is mounted on the rim 22. A plurality of ribs 220 extend from an outer periphery of the rim 22 so as to securely connect the tire 21 on the rim 22. A plurality ridges 221 extend from an inner periphery of the rim 22. Two side members 23 are respectively engaged with two sides of the rim 22 and each side member 23 has receiving grooves 230 for receiving the ridges 221 of the rim 22 so that the side members 23 are co-rotated with the rim 22. Each side member 23 includes a plurality of spokes 231 located at an inner periphery thereof and a hole 232 is defined in a center of each of the side members 23. A connection member 24 extends through the hole 232. The connection member 24 includes a stop flange 250 at one end and a fixing end 251 at the other end thereof. The stop flange 250 is engaged with an outside of a periphery of the hole 232 and the fixing end 251 extends through the other side member 23 and is connected with a nut 25. The nut 25 includes a flange 250 on outer periphery and a threaded section 251 is defined in an inner periphery so as to be threadedly connected with the fixing end 251.

Each of the connection members 24 includes a central passage 242, two bearings 26 are located at two ends of the central passage 242 and a sleeve 27 is located at a center of the central passage 242. The shaft 12 extends through the bearings 26 and the sleeve 27, and two ends of the shaft 12 are connected to two nuts 13. Two end caps 28 are respectively connected to two respective distal ends of the two shafts 12 of each truck 11. Each of the two end caps 28 includes a flexible periphery 280 and a display area 281 is defined in an outside of each end cap 28. The flexible periphery 280 allows the end cap 28 to be easily mounted to the nut 13. The display area 281 is used for displaying trademarks or commercial patterns.

A circular recessed area 233 enclosed by the spokes 231 of each the side members 23 is capable of touching a brake member 54 of the at least one brake device 50 to brake the wheel 20.

There are advantages for the skateboard of the present invention:

1. The brake device is controlled by user's feet so that no long brake cable exposed which could tangle objects. The user's hands are free and can hold the deck when performing some stunt actions.

2. The brake device is combined with the deck so that the whole structure is impact and highly safe. The braking action is controlled by feet rather than by hands so that the deck has more free range to roll and flip.

3. Because of no long brake cable, the skateboard is convenient to be carried.

4. The wheel assembly includes symmetric side members which is connected with each other by a single connection member so that the wheel assembly can be quickly assembled and only one mold for manufacturing the side members.

5. Each part of the wheel assembly can be individually replaced, for example the side members are identical which are easily replaced.

6. The connection member is located at a center of the wheel and includes a tapered outer periphery which is benefit for auto-alignment of the side members and the rim when assembling the wheel assembly.

Figure 8:
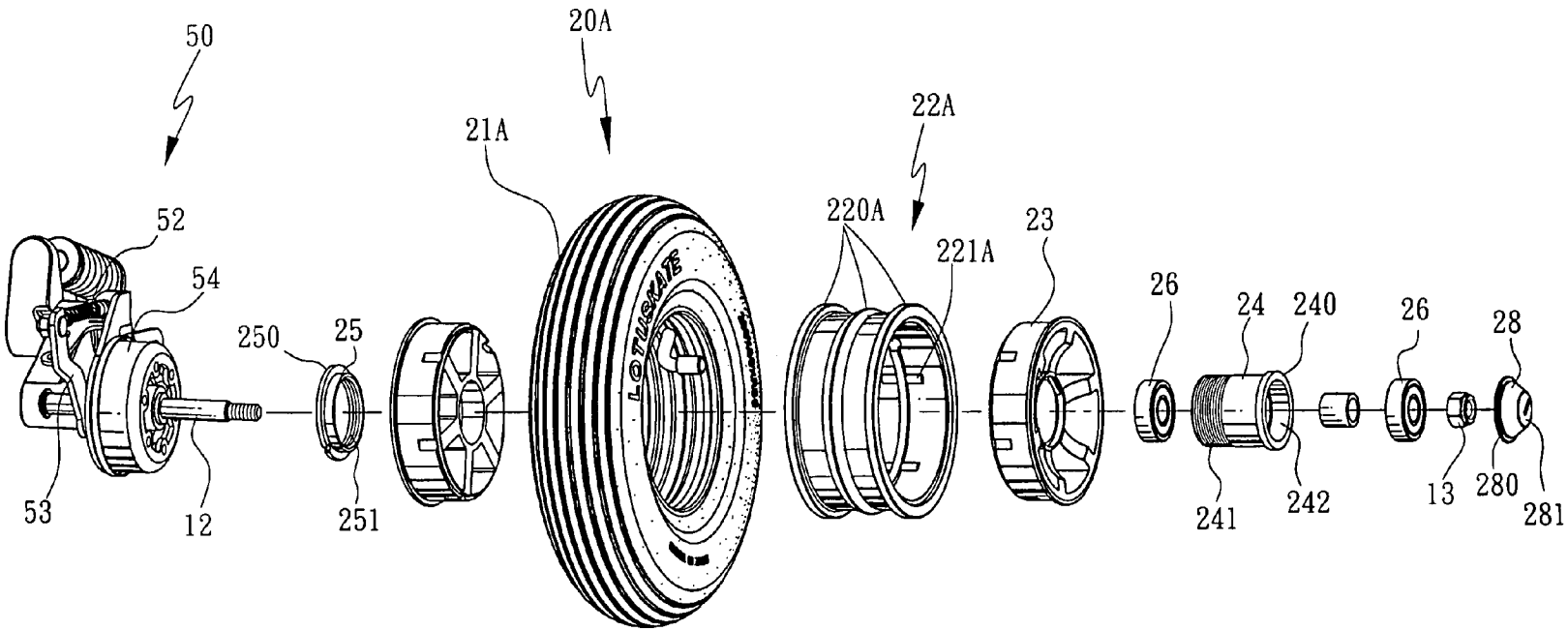
FIG. 8 a cross sectional view to show another wheel assembly of the skateboard of the present invention.

The wheel 20 can also be replaced with certain type of tire such as the tire 21A in FIG. 8, which is an inflatable tire 21A. The rim 22A includes lips 220A for positioning the inflatable tire 21A and a ridge 221 A extends from the outer periphery of the rim 22A for cooperation with other parts of the wheel assembly. The connection member 24, the nut 25, the bearings 26, the sleeve 27 are the same as the wheel assembly in FIG. 6.

Figure 9:
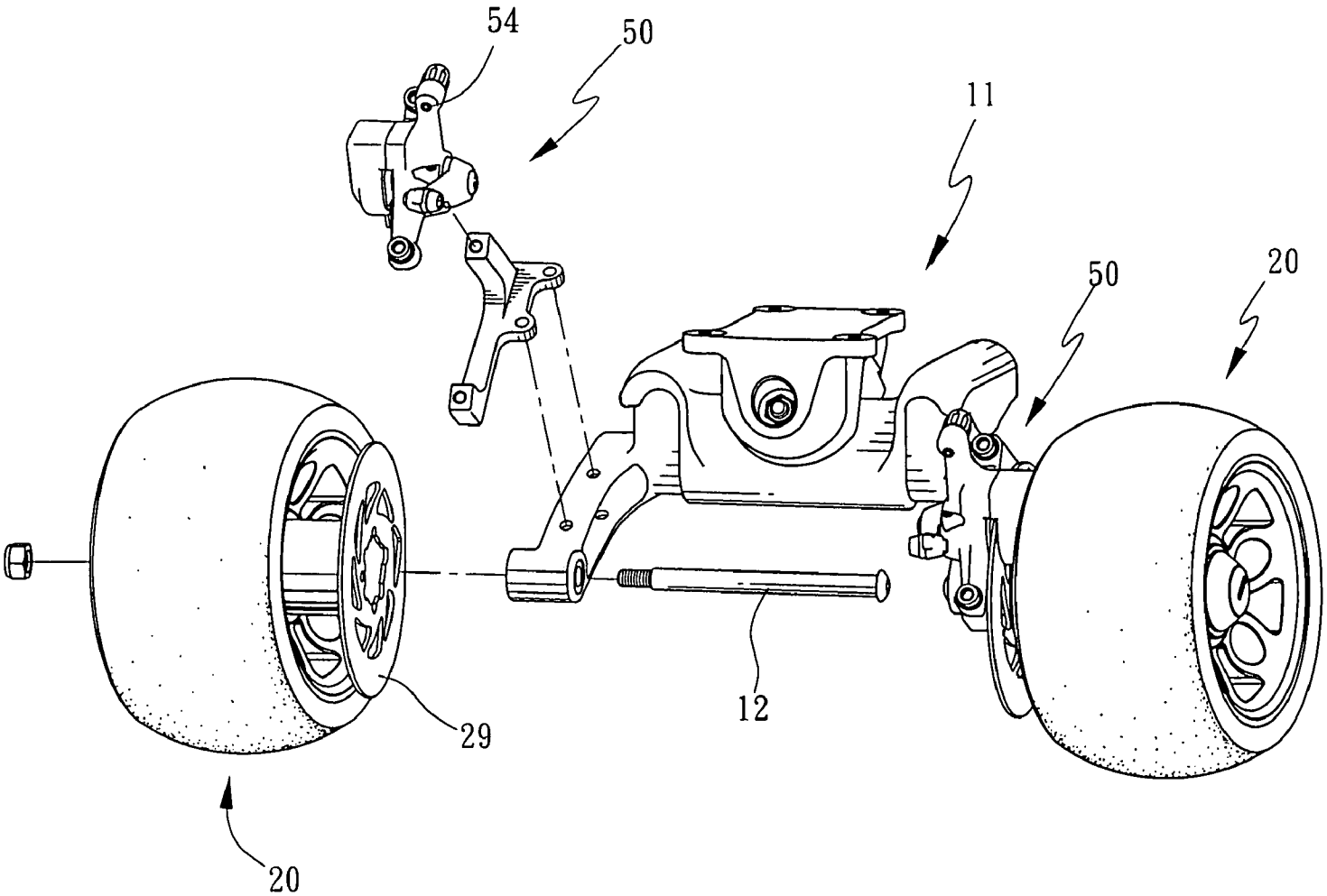
FIG. 9 shows the brake device is a disk brake mechanism.
Figure 10:
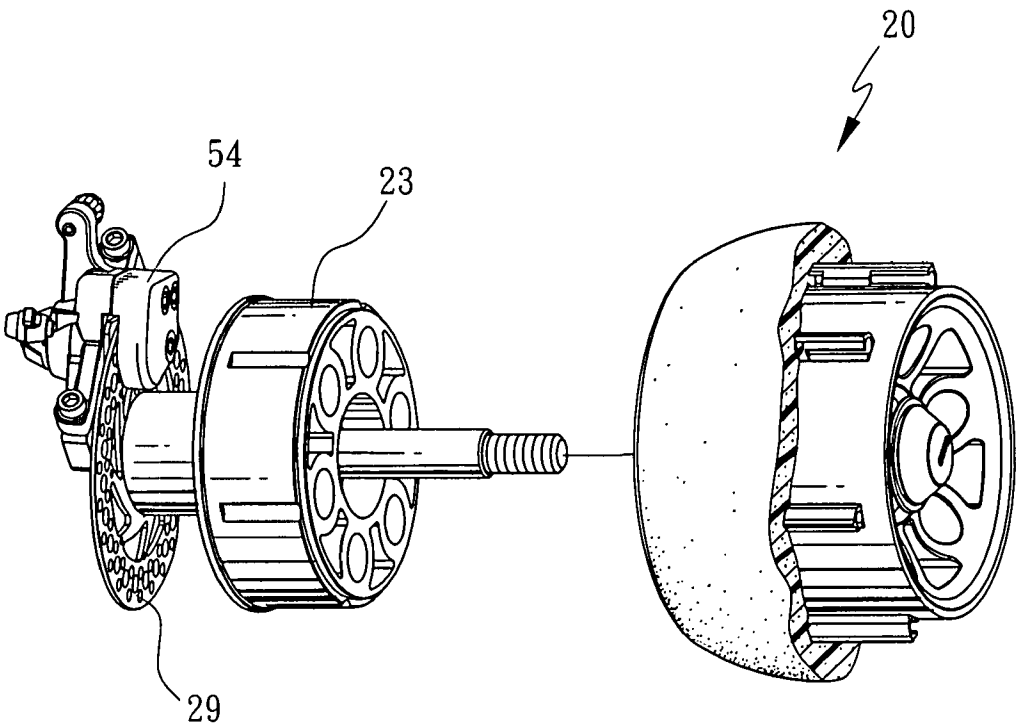
FIG. 10 is an exploded view to show the brake device in FIG. 9.

As shown FIGS. 9 and 10, the brake member 54 is cooperated with a brake disk 29 which integrally extends from one of the side members 23, and the brake device 50 is the conventional disk brake device. When maintaining, the side member together with the brake disk 29 can be easily replaced with a new set.

Figure 11:
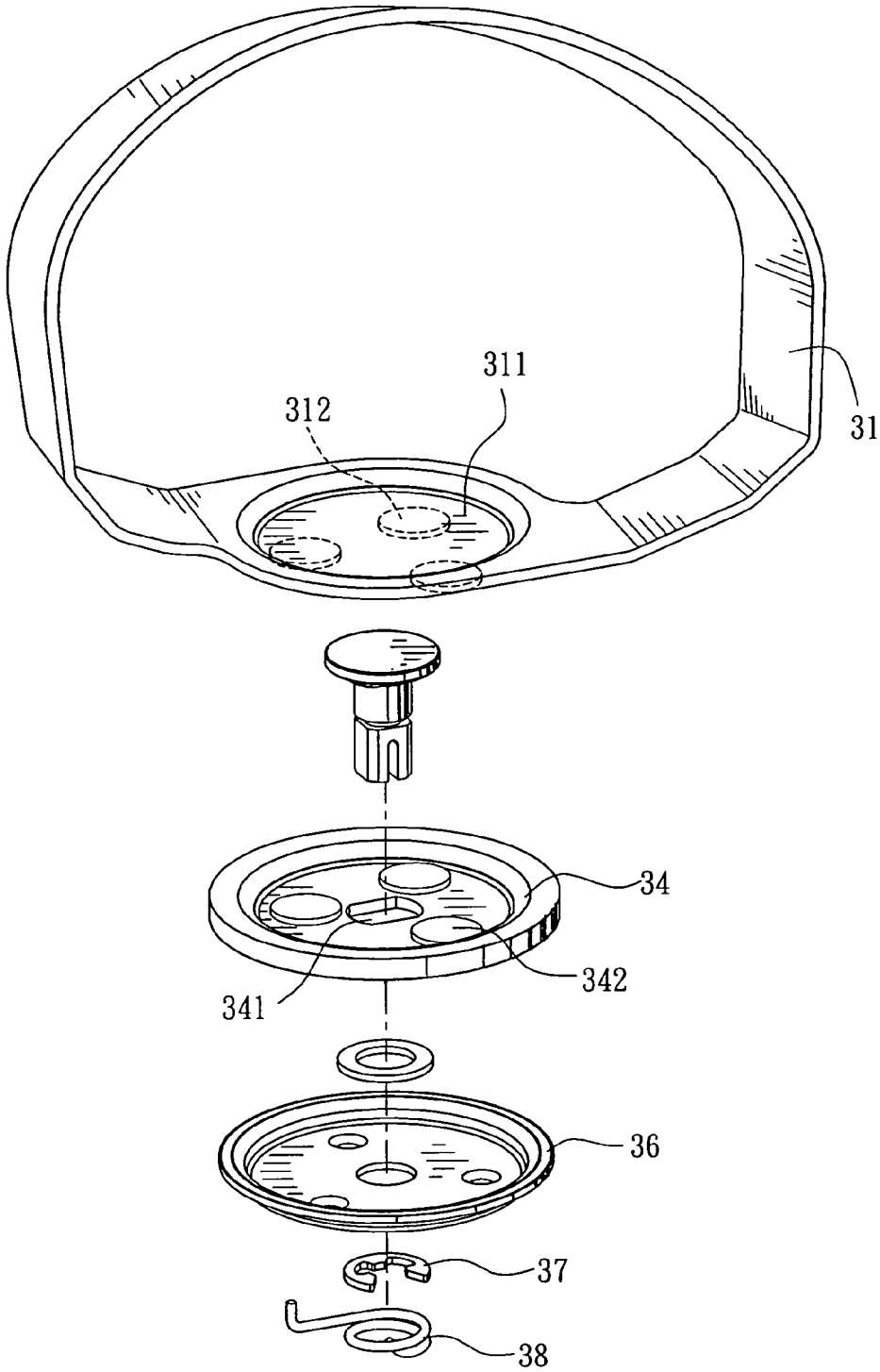
FIG. 11 shows another embodiment of the active device.

As shown in FIG. 11, the strap 31 of the at least one active device 30 includes a suction portion 311 which includes a plurality of suction disks 312. The driving member 34 includes a plurality of suction members 342 which are sucked by the suction disks 312. The suction disks 312 can also be magnetic disks.

While we have shown and described the embodiment in accordance with the present invention, it should be clear to those skilled in the art that further embodiments may be made without departing from the scope of the present invention.

What is claimed is:

1. A skateboard comprising:

a deck (10) and two trucks (11) connected to an underside of the deck (10), two shafts (12) connected to two ends of each of the two trucks (11) and a wheel (20) rotatably connected to each of the shafts (12), and at least one active device (30) connected to a top of the deck (10) and being adapted to be controlled by user's foot, the at least one active device (30) having a driving member (34) which is connected to a brake cable (51) of at least one brake device (50), the deck (10) including a receiving port (101) for receiving the at least one active device (30), the receiving port (101) including a through hole (102) such that the at least one active device (30) is pivotably connected to the deck (10) via the through hole (102), a plurality of fixing portions (103) being disposed in the underside of the deck (10) and located around the through hole (102) so that an at least one synchronic device (40) is connected to the deck (10).

2. A skateboard comprising:

a deck (10) and two trucks (11) connected to an underside of the deck (10), two shafts (12) connected to two ends of each of the two trucks (11) and a wheel (20) rotatably connected to each of the shafts (12), the deck (10) including a receiving port (101) for receiving the at least one active device (30);

at least one active device (30) connected to a top of the deck (10) and being adapted to be controlled by user's foot, the receiving port (101) including a through hole (102) such that the at least one active device (30) is pivotably connected to the deck (10) via the through hole (102);

at least one synchronic device (40) connected to the underside of the deck (10) and controlled by the at least one active device (30) so as to synchronically pull a plurality of brake cables (51) of at least one brake device (50), the at least one active device (30) having a driving member (34) which is connected to the brake cables (51) of the at least one brake device (50) via the at least one synchronic device (40); and a plurality of fixing portions (103) being disposed in the underside of the deck (10) and located around the through hole (102) so that the at least one synchronic device (40) is connected to the deck (10).

3. The skateboard as claimed in claims 1 or 2, wherein the at least one active device (30) includes a strap (31) which is located at the top of the deck (10) and the driving member (34) is connected to the strap (31), a driving piece (35) extends through a center of the driving member (34) and the deck (10) so as to be connected with the at least one synchronic device (40).

4. The skateboard as claimed in claim 3, wherein two connection ends (310) are defined at two ends of the strap (31) and two positioning members (32) extend through the two connection ends (310) and two holes (340) of the driving member (34), and are threadedly connected with two nuts (33).

5. The skateboard as claimed in claim 3, wherein the driving member (34) includes a polygonal hole (341) through which the driving piece (35) extends, the driving piece (35) includes a top flange (350), a polygonal section (351) extending from the top flange (350), a cylindrical section (352) connected to the polygonal section (351) and an engaging end (354) connected to the cylindrical section (352), the polygonal section (351) is engaged with the polygonal hole (341) in the driving member (34) so as to drive the driving member (34), the cylindrical section (352) extends through a disk (36) and includes a groove (353) with which a clamp (37) is engaged, the engaging end (354) is connected to the at least one synchronic device (40), the engaging end (354) includes a notch (355) and an end of a torsion spring (38) is engaged with the notch (355), the other end of the torsion spring (38) is fixed to the disk (36) which includes connection holes (360) for being connected to the deck (10).

6. The skateboard as claimed in claim 3, wherein the strap (31) of the at least one active device (30) includes a suction portion (311) which includes a plurality of suction disks (312), the driving member (34) includes a plurality of suction members (342) which are sucked by the suction disks (312).

7. The skateboard as claimed in claim 6, wherein the suction disks (312) are magnetic disks.

8. The skateboard as claimed in claims 1 or 2, wherein the brake device (50) is a drum brake device and connected to the brake cables (51), the brake cables (51) drives the drum brake device (50) by a spring (52) and a crank (53).

9. The skateboard as claimed in claim 2, wherein the at least one synchronic device (40) includes a case (41) which includes connection tubes (410) so as to be fixed to the deck (10), a central hole (42) is defined in a center of the case (41) and an arm (42) is pivotably engaged with the central hole (42), the case (41) includes a guide portion (412) and a connection board (43) is received in the guide portion (412), a link (44) is pivotably connected between the connection board (43) and the arm (42), two apertures (413) are defined through a wall of the guide portion (412) so that the brake cables (51) extend through the apertures (413).

10. The skateboard as claimed in claim 9, wherein the arm (42) includes a polygonal hole (420) and the engaging end (354) of the driving piece (35) is engaged, a slot (421) is defined in an end of the arm (42) and one end of the link (44) is pivotably engaged with the slot (421), the other end of the link (44) is pivotably connected to the connection board (43), two receiving recesses (430) are defined in the connection board (43) so as to receive terminals (510) of the brake cables (51) therein, sheaths (511) of the brake cables (51) are stopped by the outside of the guide portion (412) of the case (41).

11. A skateboard comprising:

a deck (10) and a plurality of trucks (11) connected to an underside of the deck (10), two shafts (12) connected to two ends of each of the two trucks (11) and a wheel (20) rotatably connected to each of the shafts (12), the wheel (20) includes a rim (22) and a tire (21) is mounted on the rim (22), a plurality of ribs (220) extend from an outer periphery of the rim (22) and a plurality ridges (221) extend from an inner periphery of the rim (22);

two side members (23) are respectively engaged with two sides of the rim (22) and each side member (23) has receiving grooves (230) for receiving the ridges (221) of the rim (22), each side member (23) includes a plurality of spokes (231) located at an inner periphery thereof and a hole (232) defined in a center of each of the side members (23), a connection member (24) extends through the hole (232), and the connection member (24) includes a stop flange (250) at one end and a fixing end (251) at the other end thereof, the stop flange (250) is engaged with an outside of a periphery of the hole (232) and the fixing end (251) extends through the other side member (23) and is connected with a nut (25).

12. The skateboard as claimed in claim 11, wherein the connection member (24) includes a central passage (242), two bearings (26) are located at two ends of the central passage (242) and a sleeve (27) is located at a center of the central passage (242).

13. The skateboard as claimed in claim 11, wherein two end caps (28) are respectively connected to two respective distal ends of the two shafts (12) of each truck (11).

14. The skateboard as claimed in claim 11, wherein each of the two end caps (28) includes a flexible periphery (280) and a display area (281) is defined in an outside of each end cap (28).

15. The skateboard as claimed in claims 1, 2 or 11, wherein a circular recessed area enclosed by the spokes (231) of each the side members (23) is capable of touching a brake member (54) of the at least one brake device (50).

16. The skateboard as claimed in claims 1, 2 or 11, wherein the brake member (54) is cooperated with a brake disk (29) which integrally extends from one of the side members (23).

* * * * *